US009523316B2

(12) United States Patent
Tagawa et al.

(10) Patent No.: US 9,523,316 B2
(45) Date of Patent: Dec. 20, 2016

(54) VAPORIZED FUEL PROCESSING APPARATUS

(71) Applicant: AISAN KOGYO KABUSHIKI KAISHA, Obu-shi, Aichi-ken (JP)

(72) Inventors: Naoyuki Tagawa, Nagoya (JP); Minoru Akita, Ama (JP); Yoshikazu Miyabe, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 186 days.

(21) Appl. No.: 14/563,237

(22) Filed: Dec. 8, 2014

(65) Prior Publication Data

US 2015/0159568 A1 Jun. 11, 2015

(30) Foreign Application Priority Data

Dec. 6, 2013 (JP) ..... 2013-252874

(51) Int. Cl.
*F02D 41/00* (2006.01)
*F02M 25/08* (2006.01)
(Continued)

(52) U.S. Cl.
CPC ..... *F02D 41/003* (2013.01); *F02D 41/004* (2013.01); *F02D 41/1402* (2013.01);
(Continued)

(58) Field of Classification Search
CPC ..... F02D 41/00; F02D 41/003; F02D 41/004; F02D 41/14; F02D 41/1402; F02D 2200/0602; F02M 25/08; F02M 25/0818; F02M 25/0809; Y10T 13/86485
See application file for complete search history.

(56) References Cited

U.S. PATENT DOCUMENTS 6,631,635 B2 * 10/2003 Hanazaki ..... F02M 25/0809 73/114.38
6,698,280 B1 * 3/2004 Iden ..... F02M 25/0818 73/114.38
(Continued)

FOREIGN PATENT DOCUMENTS

DE 19838959 A1 3/2000
DE 102010014558 A1 10/2011
(Continued)

OTHER PUBLICATIONS

German Patent Application No. DE 10 2014 017 158.2 Office Action dated Jun. 16, 2015 (7 pages).

*Primary Examiner* — Hieu T Vo
(74) *Attorney, Agent, or Firm* — Conley Rose, P.C.

(57) ABSTRACT

A vaporized fuel processing apparatus has a canister capable of adsorbing vaporized fuel generated in a fuel tank, a closing valve provided in the vapor path connecting the canister and the fuel tank and having a valve seat and a valve movable portion, a pressure sensor configured to detect inner pressure of the fuel tank, and an electric control unit. The electric control unit is configured to set a learning value that is an axial distance between the valve seat and the valve movable portion at a valve opening start position at a fail-safe value such that the closing valve is in the valve closing state when the inner pressure of the fuel tank decreases by less than a predetermined value after repeating a stroke control process more than predetermined times.

8 Claims, 14 Drawing Sheets

(51) Int. Cl.
*F02D 41/14* (2006.01)
*F02D 41/24* (2006.01)

(52) U.S. Cl.
CPC .. *F02D 41/2464* (2013.01); *F02D 2200/0602* (2013.01); *Y10T 137/86485* (2015.04)

(56) References Cited

U.S. PATENT DOCUMENTS

| | | | |
|---|---|---|---|
| 8,607,765 | B2 | 12/2013 | Hagen |
| 2011/0296997 | A1 | 12/2011 | Sugiura |
| 2014/0102420 | A1 | 4/2014 | Kimoto et al. |

FOREIGN PATENT DOCUMENTS

| | | | |
|---|---|---|---|
| DE | 102013016984 | A1 | 4/2014 |
| JP | 05-33729 | A | 2/1993 |
| JP | 08-74678 | A | 3/1996 |
| JP | 10-299583 | A | 11/1998 |
| JP | 10-299586 | A | 11/1998 |
| JP | 2004-156496 | A | 6/2004 |
| JP | 2004-308483 | A | 11/2004 |
| JP | 2005-155323 | A | 6/2005 |
| JP | 2010-281258 | A | 12/2010 |
| JP | 2011-256778 | A | 12/2011 |
| JP | 2013-104316 | A | 5/2013 |
| JP | 2013-113198 | A | 6/2013 |

* cited by examiner

VAPORIZED FUEL PROCESSING APPARATUS

CROSS-REFERENCE TO RELATED APPLICATIONS

This application claims priority to Japanese patent application serial number 2013-252874, filed Dec. 6, 2013, the contents of which are incorporated herein by reference in their entirety.

STATEMENT REGARDING FEDERALLY SPONSORED RESEARCH OR DEVELOPMENT

Not Applicable.

BACKGROUND

This disclosure relates to a vaporized fuel processing apparatus including a canister equipped with an adsorbent capable of adsorbing vaporized fuel generated in a fuel tank, and a closing valve provided in a vapor path connecting the canister and the fuel tank to each other.

A pertinent conventional vaporized fuel processing apparatus is disclosed in Japanese Laid-Open Patent Publication No. 2011-256778. The vaporized fuel processing apparatus according to Japanese Laid-Open Patent Publication No. 2011-256778 is equipped with a closing valve (control valve) provided in a vapor path connecting a canister and a fuel tank to each other. The closing valve is equipped with a dead zone region (valve-closing region) shutting off the vaporized fuel, and a conduction region (valve-opening region) allowing the vaporized fuel to pass; in the valve closing state, the fuel tank is maintained in a hermetic state; and, in the valve opening state, the vaporized fuel in the fuel tank is caused to escape to the canister side, making it possible to lower the inner pressure of the fuel tank. In the vaporized fuel processing apparatus according to Japanese Laid-Open Patent Publication No. 2011-256778, learning control is performed as follows. The degree of opening of the closing valve is changed in the opening direction at a predetermined speed from the valve-closing position; and when the inner pressure of the fuel tank begins to be reduced, the degree of opening of the closing valve is stored as the valve opening start position.

However, when the inner pressure of the fuel tank cannot be detected during the learning control, it cannot be detected when the inner pressure of the fuel tank begins to decrease. Thus, there is a case that the learning control is not completed although the closing valve is actually opened, so that an inappropriate value may be stored as the learning value. Accordingly, there has been a need for improved vaporized fuel processing apparatuses.

BRIEF SUMMARY

In one aspect of this disclosure, a vaporized fuel processing apparatus has a canister capable of adsorbing vaporized fuel generated in a fuel tank, a vapor path connecting the canister and the fuel tank to each other, a closing valve provided in the vapor path and having a valve seat and a valve movable portion, a pressure sensor configured to detect inner pressure of the fuel tank, and an electric control unit. The valve movable portion has an axis and is capable of moving in an axial direction of the valve movable portion respect to the valve seat. When a stroke amount that is an axial distance between the valve seat and the valve movable portion is within a predetermined range from zero, the closing valve is in a valve closing state capable of remaining the fuel tank in a hermetic state. The electric control unit is configured to learn a valve opening start position of the closing valve depending on the stroke amount when the inner pressure of the fuel tank decreases by not less than (i.e., greater than or equal to) a predetermined value through changing the stroke amount in stages in the valve opening direction by a stroke control process, and, during learning of the valve opening start position of the closing valve, to set a learning value that is the stroke amount at the valve opening start position at a fail-safe value such that the closing valve is in the valve closing state when the inner pressure of the fuel tank decreases by less than the predetermined value after repeating the stroke control process more than a predetermined number of times.

According to the aspect of this disclosure, for example, even if the inner pressure of the fuel tank cannot be detected during the learning of the valve opening start position, the learning value is set at the fail-safe value, in which the closing valve is in the valve closing state. Accordingly, it is possible to prevent erroneous learning, for example, the stroke amount in a state that the closing valve is open is learned as the learning value.

BRIEF DESCRIPTION OF THE DRAWINGS

FIG. 10 is a graph illustrating the learning control in a state that a tank inner pressure abnormal flag is on;

FIG. 12 is a graph illustrating the learning control in a state that an ignition switch is on and that the tank inner pressure abnormal flag is on;

DETAILED DESCRIPTION

Each of the additional features and teachings disclosed above and below may be utilized separately or in conjunction with other features and teachings to provide improved vaporized fuel processing apparatuses. Representative examples, which utilize many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary in the broadest sense, and are instead taught merely to particularly describe representative examples. Moreover, various features of the representative examples and the dependent claims may be combined in ways that are not specifically enumerated in order to provide additional useful embodiments of the present teachings.

Figure 1:
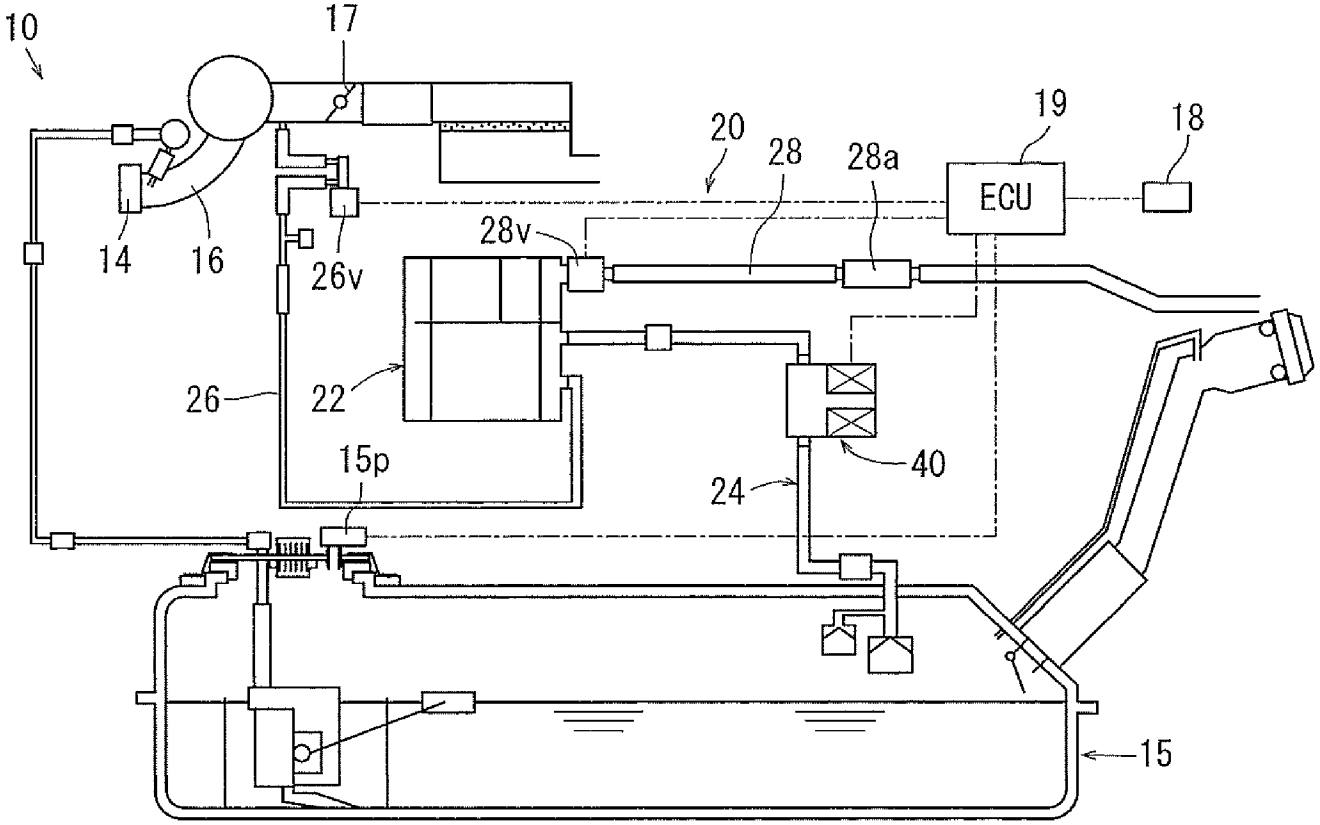
FIG. 1 is a diagram illustrating the construction of a vaporized fuel processing apparatus according to a first embodiment of this disclosure.

A vaporized fuel processing apparatus 20 according to a first embodiment of this disclosure will be described with reference to FIGS. 1 through 4. As shown in FIG. 1, the vaporized fuel processing apparatus 20 of the present embodiment is provided in a vehicle engine system 10 and is configured to prevent leakage of vaporized fuel from a fuel tank 15 of the vehicle to the exterior.

As shown in FIG. 1, the vaporized fuel processing apparatus 20 is equipped with a canister 22, a vapor path 24 connected to the canister 22, a purge path 26, and an atmosphere path 28. The canister 22 is loaded with activated carbon as the adsorbent, and vaporized fuel which has been generated in the fuel tank 15 is adsorbed by the adsorbent. One end portion (upstream side end portion) of the vapor path 24 communicates with a gaseous layer portion in the fuel tank 15, and the other end portion (downstream side end portion) of the vapor path 24 communicates with the interior of the canister 22. At some midpoint of the vapor path 24, there is provided a closing valve 40 (described below) configured to allow/prohibit communication through the vapor path 24. One end portion (upstream side end portion) of the purge path 26 communicates with the interior of the canister 22, and the other end portion (downstream side end portion) of the purge path 26 communicates with the path portion on the downstream side of a throttle valve 17 in an intake path 16 of an engine 14. At some midpoint of the purge path 26, there is provided a purge valve **26*v* configured to allow/prohibit communication through the purge path 26. Further, the canister 22 communicates with the atmosphere path 28 via an on-board diagnostics (OBD) component 28*v* for failure detection. At some midpoint of the atmosphere path 28, there is provided an air filter 28*a*, and the other end portion of the atmosphere path 28 is open to the atmosphere. The closing valve 40, the purge valve 26*v*, and the OBD component 28*v* are controlled based on signals from an electric control unit (ECU) 19. Further, signals from a tank inner pressure sensor 15*p* for detecting the pressure in the fuel tank 15, etc. are input to the ECU 19**.

Next, the basic operation of the vaporized fuel processing apparatus 20 will be described. While the vehicle is at rest, the closing valve 40 is maintained in the closed state. Thus, no vaporized fuel flows into the canister 22 from the fuel tank 15. When an ignition switch 18 of the vehicle is turned on while the vehicle is at rest, there is performed learning control in which the valve opening start position for the closing valve 40 is learned. Further, while the vehicle is at rest, the purge valve **26*v* is maintained in the closed state, and the purge path 26 is in the cut-off state, with the atmosphere path 28 being maintained in the communication state. While the vehicle is traveling, when a predetermined purge condition holds good, the ECU 19 performs a control operation for purging the vaporized fuel adsorbed in the canister 22. In this control operation, opening/closing control is performed on the purge valve 26*v* while allowing the canister 22 to communicate with the atmosphere via the atmosphere path 28. When the purge valve 26*v* is opened, the intake negative pressure of the engine 14 acts on the interior of the canister 22 via the purge path 26. As a result, air flows into the canister 22 via the atmosphere path 28. Further, when the purge valve 26*v* is opened, the closing valve 40 operates in the valve opening direction to perform depressurization control of the fuel tank 15 (described below). Thus, the gas flows into the canister 22 from the fuel tank 15 via the vapor path 24. As a result, the adsorbent in the canister 22 is purged by the air, etc. flowing into the canister 22, and the vaporized fuel separated from the adsorbent is guided to the intake path 16 of the engine 14 together with the air before being burnt in the engine 14**.

Figure 2:
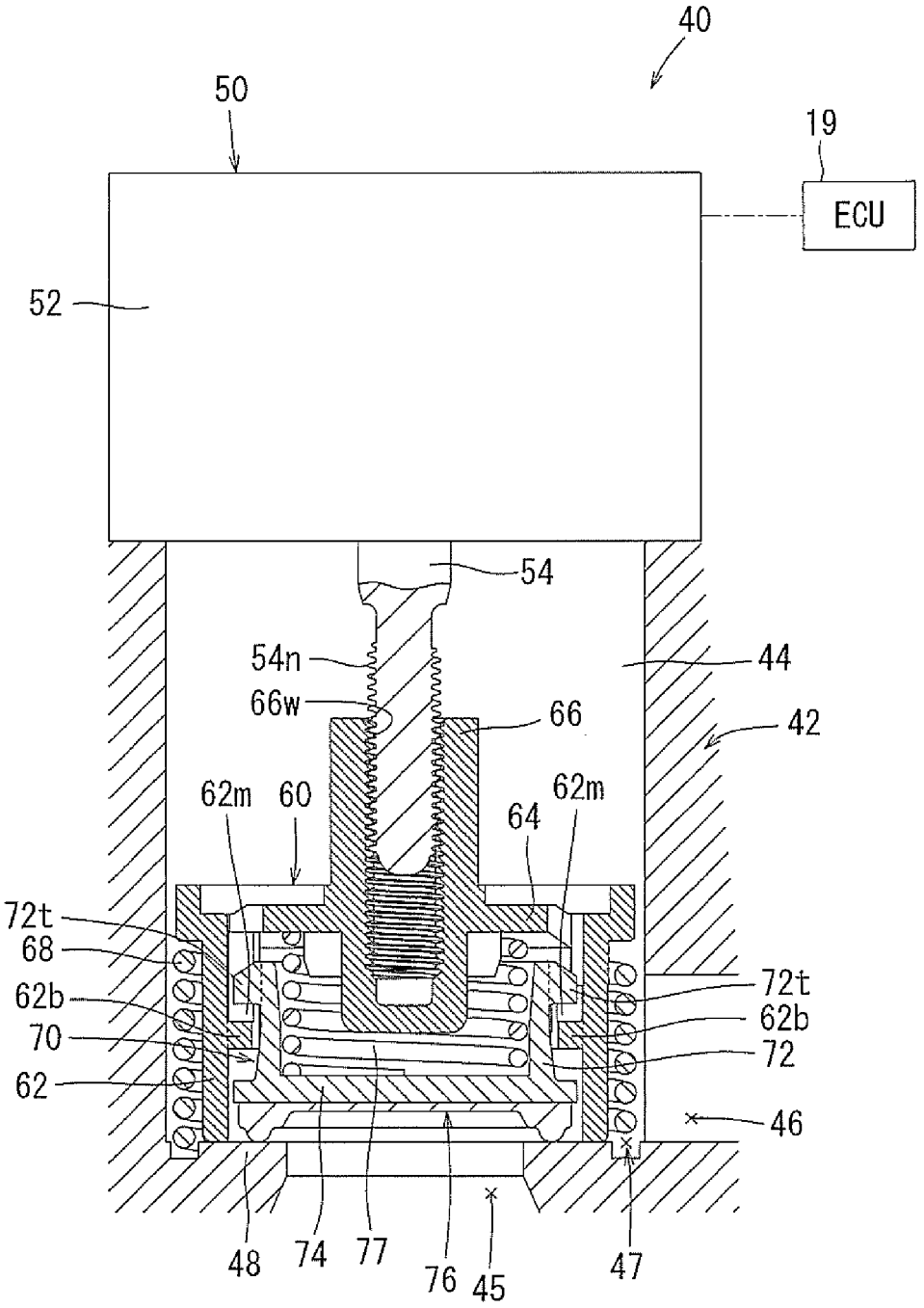
FIG. 2 is a longitudinal sectional view illustrating an initialization state of a closing valve used in the vaporized fuel processing apparatus.

The closing valve 40 is a flow rate control valve configured to close the vapor path 24 in the closed state, and to control the flow rate of the gas flowing through the vapor path 24 in the open state. As shown in FIG. 2, the closing valve 40 is equipped with a valve casing 42, a stepping motor 50, a valve guide 60, and a valve body 70. In the valve casing 42, there is formed a continuous, reverse L-shaped fluid passage 47 by a valve chamber 44, an inflow path 45, and an outflow path 46. A valve seat 48 is formed concentrically on the lower surface of the valve chamber 44, that is, at the port edge portion of the upper end opening of the inflow path 45. The stepping motor 50 is installed on top of the valve casing 42. The stepping motor 50 has a motor main body 52, and an output shaft 54 protruding from a lower surface of the motor main body 52 and capable of normal and reverse rotation. The output shaft 54 is concentrically arranged within the valve chamber 44 of the valve casing 42, and a male screw portion **54*n* is formed on the outer peripheral surface of the output shaft 54**.

The valve guide 60 is formed as a topped cylinder by a cylindrical tubular wall portion 62 and an upper wall portion 64 closing the upper end opening of the tubular wall portion 62. At the central portion of the upper wall portion 64, there is concentrically formed a tubular shaft portion 66, and a female screw portion **66*w* is formed on the inner peripheral surface of the tubular shaft portion 66. The valve guide 60 is arranged so as to be movable in the axial direction (vertical direction) while prohibited from rotating around the axis by a detent means (not shown). The male screw portion 54*n* of the output shaft 54 of the stepping motor 50 is threadedly engaged with the female screw portion 66*w* of the tubular shaft portion 66 of the valve guide 60 such that the valve guide 60 can be raised and lowered in the vertical direction (axial direction) based on the normal and reverse rotation of the output shaft 54 of the stepping motor 50. Around the valve guide 60, there is provided an auxiliary spring 68 urging the valve guide 60** upwardly.

The valve body 70 is formed as a bottomed cylinder composed of a cylindrical tubular wall portion 72 and a lower wall portion 74 closing the lower end opening of the tubular wall portion 72. A seal member 76 consisting, for example, of a disc-like member formed of a rubber-like elastic material is attached to a lower surface of the lower wall portion 74. The valve body 70 is concentrically arranged within the valve guide 60, and the seal member 76 of the valve body 70 is arranged so as to be capable of abutting an upper surface of the valve seat 48 of the valve casing 42. A plurality of connection protrusions **72*t* are circumferentially formed on the outer peripheral surface of the upper end portion of the tubular wall portion 72 of the valve body 70. The connection protrusions 72*t* of the valve body 70 are engaged with vertical-groove-like connection recesses 62***m* formed in the inner peripheral surface of the tubular wall portion 62 of the valve guide 60 so as to be capable of relative movement in the vertical direction by a fixed dimension. The valve guide 60 and the valve body 70 are integrally movable upwards (in the valve opening direction), with bottom wall portions 62*b* of the connection recesses 62*m* of the valve guide 60 abutting the connection protrusions 72*t* of the valve body 70 from below. Further, a valve spring 77 constantly urging the valve body 70 downwards, i.e., in the valve closing direction, with respect to the valve guide 60, is concentrically arranged between the upper wall portion 64 of the valve guide 60 and the lower wall portion 74 of the valve body 70.

Next, the basic operation of the closing valve 40 will be described. The closing valve 40 rotates the stepping motor 50 in the valve opening direction or in the valve closing direction by a predetermined number of steps based on an output signal from the ECU 19. When the stepping motor 50 rotates by the predetermined steps, the valve guide 60 moves by a predetermined stroke amount or distance in the vertical direction through threaded engagement action between the male screw portion 54*n* of the output shaft 54 of the stepping motor 50 and the female screw portion 66*w* of the tubular shaft portion 66 of the valve guide 60. In the above closing valve 40, setting is made, for example, such that, at the totally open position, the number of steps is approximately 200 and the stroke amount is approximately 5 mm. As shown in FIG. 2, in the initialized state (initial state) of the closing valve 40, the valve guide 60 is retained at the lower limit position, and the lower end surface of the tubular wall portion 62 of the valve guide 60 is in contact with the upper surface of the valve seat 48 of the valve casing 42. In this state, the connection protrusions 72*t* of the valve body 70 are situated above the bottom wall portions 62*b* of the connection recesses 62*m* of the valve guide 60, and the seal member 76 of the valve body 70 is pressed against the upper surface of the valve seat 48 of the valve casing 42 by the resilient force of the valve spring 77. That is, the closing valve 40 is maintained in the totally closed state. The number of steps of the stepping motor 50 at this time is zero (0), and the moving amount in the axial direction (upper direction) of the valve guide 60, i.e., the stroke amount in the valve opening direction, is zero (0) mm. While the vehicle is, for example, at rest, the stepping motor 50 of the closing valve 40 rotates, for example, by 4 steps in the valve opening direction from the initialized state. As a result, the valve guide 60 moves approximately 0.1 mm upwards due to the threaded engagement action between the male screw portion 54*n* of the output shaft 54 of the stepping motor 50 and the female screw portion 66*w* of the tubular shaft portion 66 of the valve guide 60, and is maintained in a state in which it is raised from the valve seat 48 of the valve casing 42. As a result, an excessive force is not easily applied between the valve guide 60 of the closing valve 40 and the valve seat 48 of the valve casing 42 due to a change in an environment factor such as temperature. In this state, the seal member 76 of the valve body 70 is pressed against the upper surface of the valve seat 48 of the valve casing 42 due to the resilient force of the valve spring 77.

Figure 3:
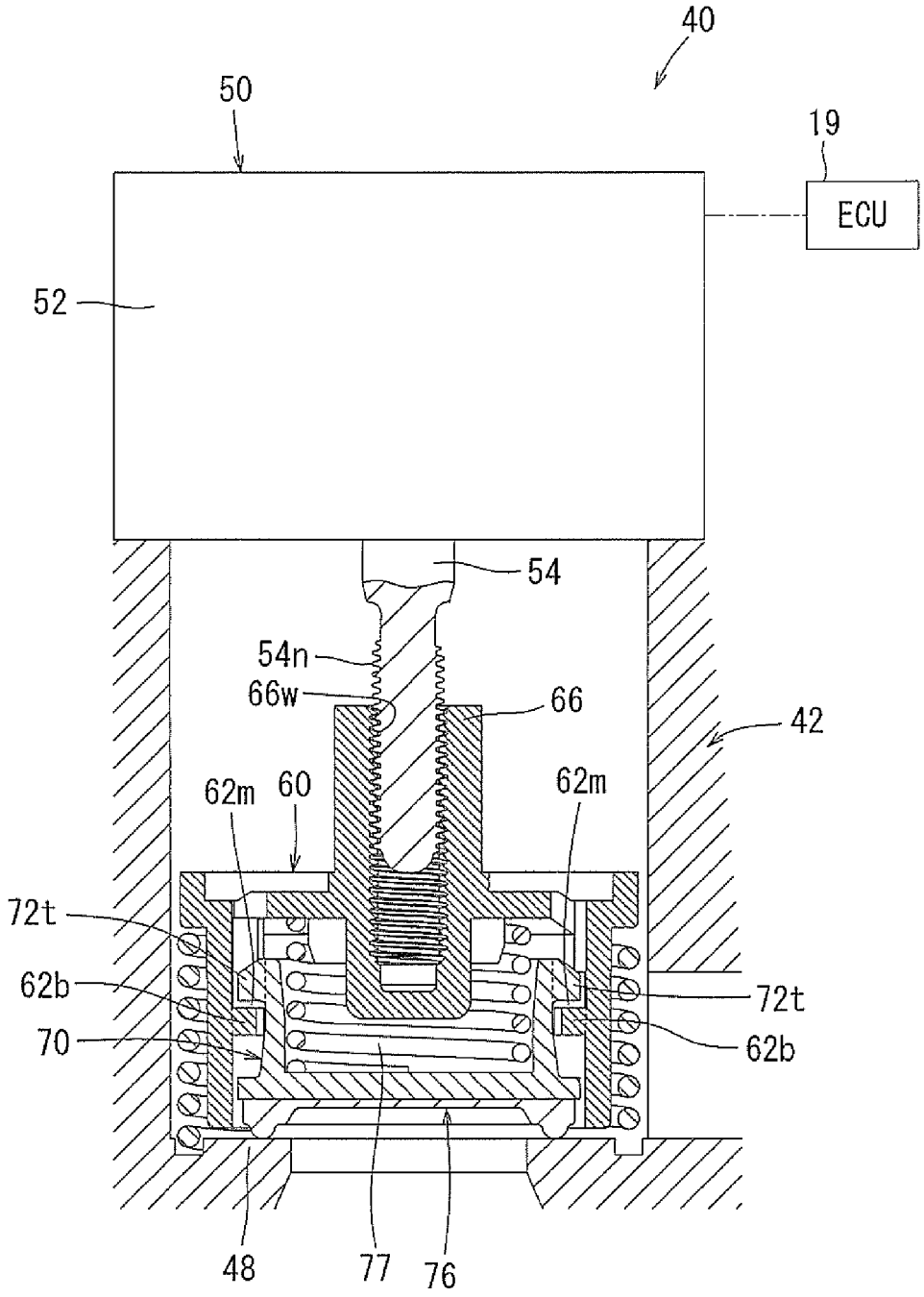
FIG. 3 is a longitudinal sectional view illustrating the valve closing state of the closing valve.
Figure 4:
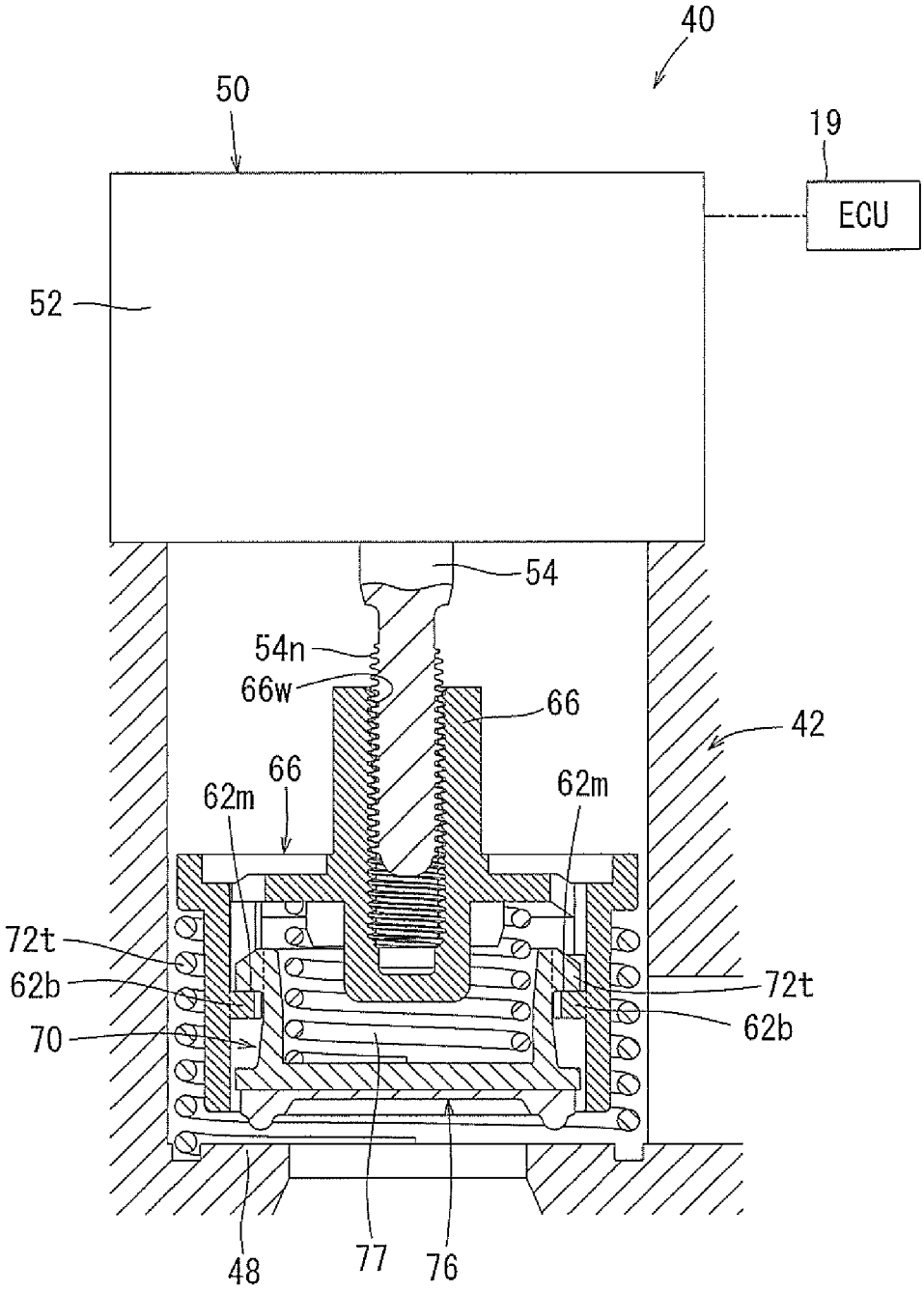
FIG. 4 is a longitudinal sectional view illustrating the valve opening state of the closing valve.

When the stepping motor 50 further rotates in the valve opening direction from the position to which the stepping motor 50 has rotated by 4 steps, the valve guide 60 moves upwards due to the threaded engagement action between the male screw portion 54*n* and the female screw portion 66*w* and, as shown in FIG. 3, the bottom wall portions 62*b* of the connection recesses 62*m* of the valve guide 60 abut the connection protrusions 72*t* of the valve body 70 from below. As shown in FIG. 4, when the valve guide 60 moves further upwards, the valve body 70 moves upwards together with the valve guide 60, and the seal member 76 of the valve body 70 is separated from the valve seat 48 of the valve casing 42. As a result, the closing valve 40 is opened. Here, the valve opening start position for the closing valve 40 differs from product to product depending upon the positional tolerance of the connection protrusions 72*t* formed on the valve body 70, the positional tolerance of the bottom wall portions 62*b* formed on the connection recesses 62*m* of the valve guide 60, etc., so that it is necessary to correctly learn the valve opening start position. This learning is performed through the learning control, and the number of steps of the valve opening start position is detected based on the timing with which the inner pressure of the fuel tank 15 is reduced by not less than a predetermined value while rotating the stepping motor 50 of the closing valve 40 in the valve opening direction (while increasing the number of steps). That is, the number of steps at the valve opening start position is a learning value. Further, hereinafter, the terms of the number of steps and the stroke amount will be used as synonyms. In this way, when the closing valve 40 is in the closed state, the valve guide 60 corresponds to the valve movable portion of this disclosure, and, when the closing valve 40 is in the open state, the valve guide 60 and the valve body 70 correspond to the valve movable portion of this disclosure.

Figure 5:
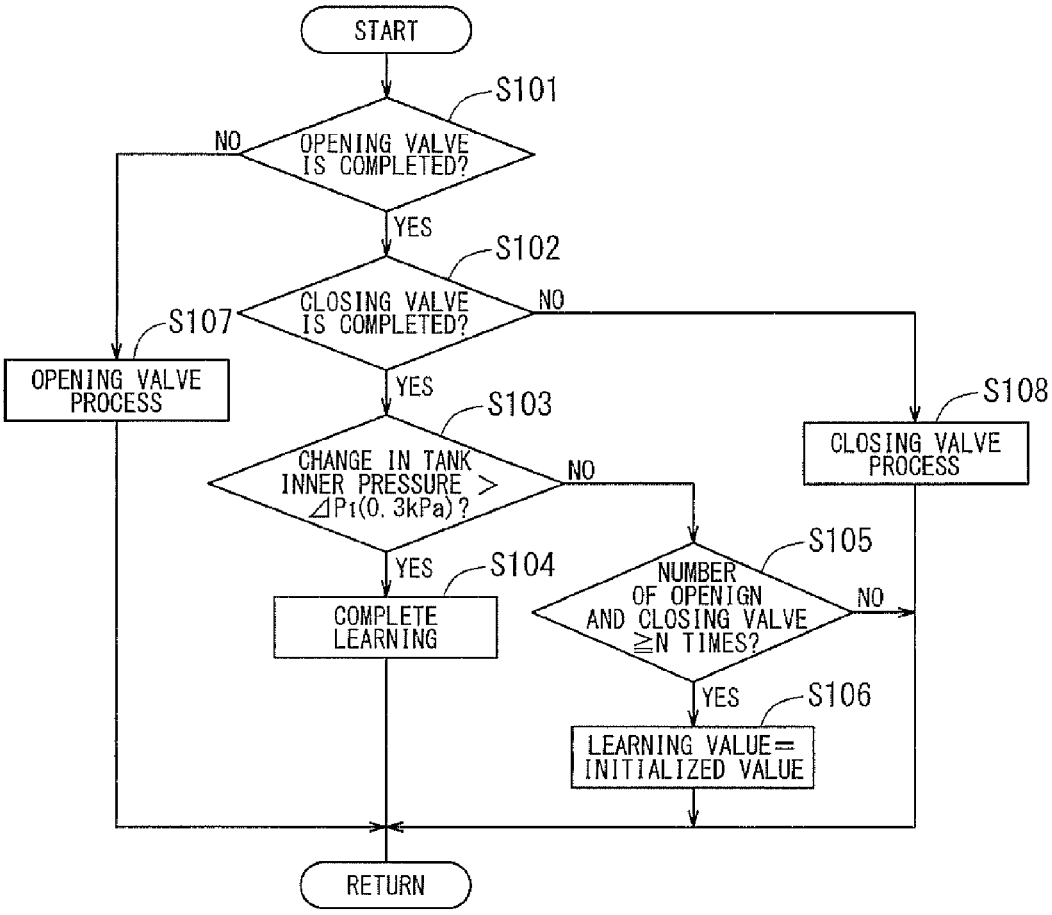
FIG. 5 is a flowchart illustrating the learning control for learning the valve opening start position of the closing valve.
Figure 6:
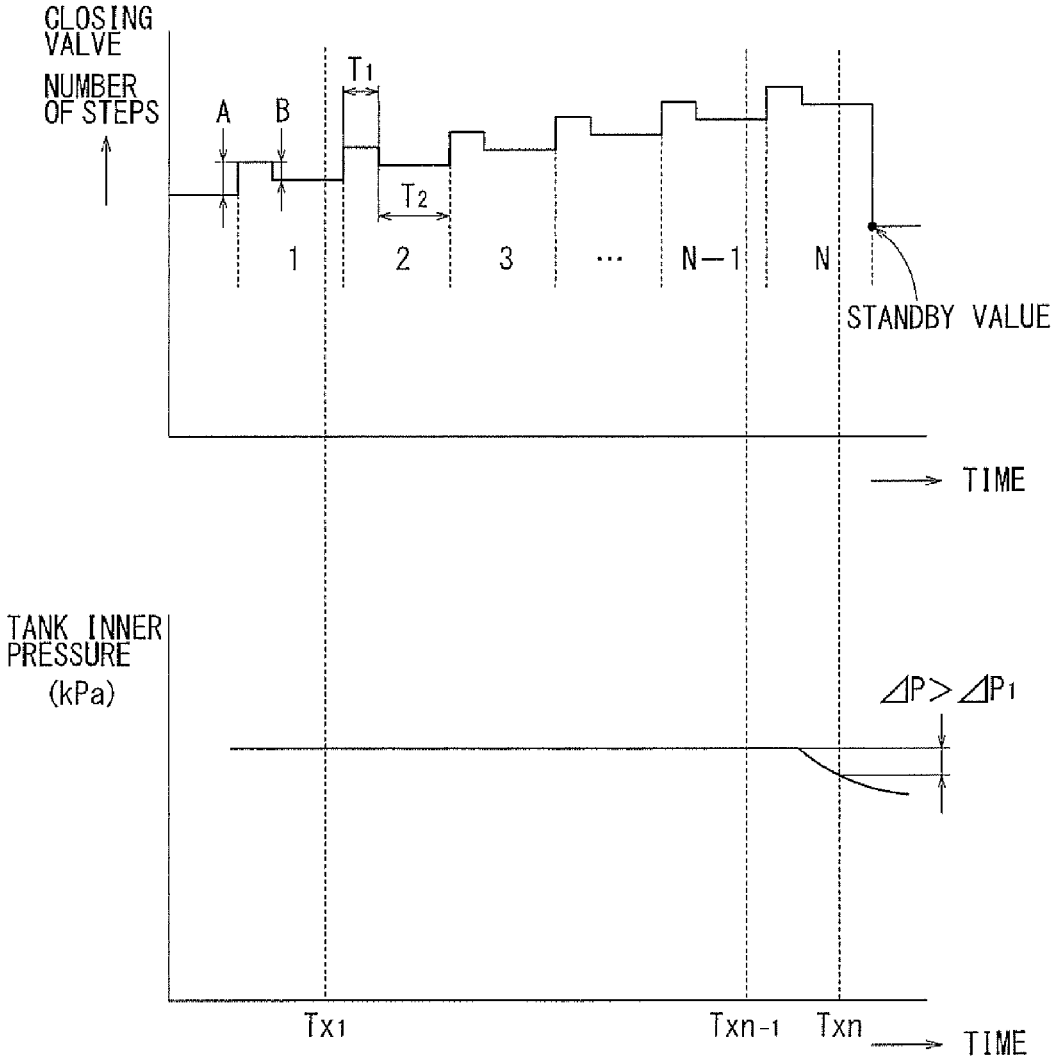
FIG. 6 is a graph illustrating the learning control in a state that the tank inner pressure can be detected.
Figure 7:
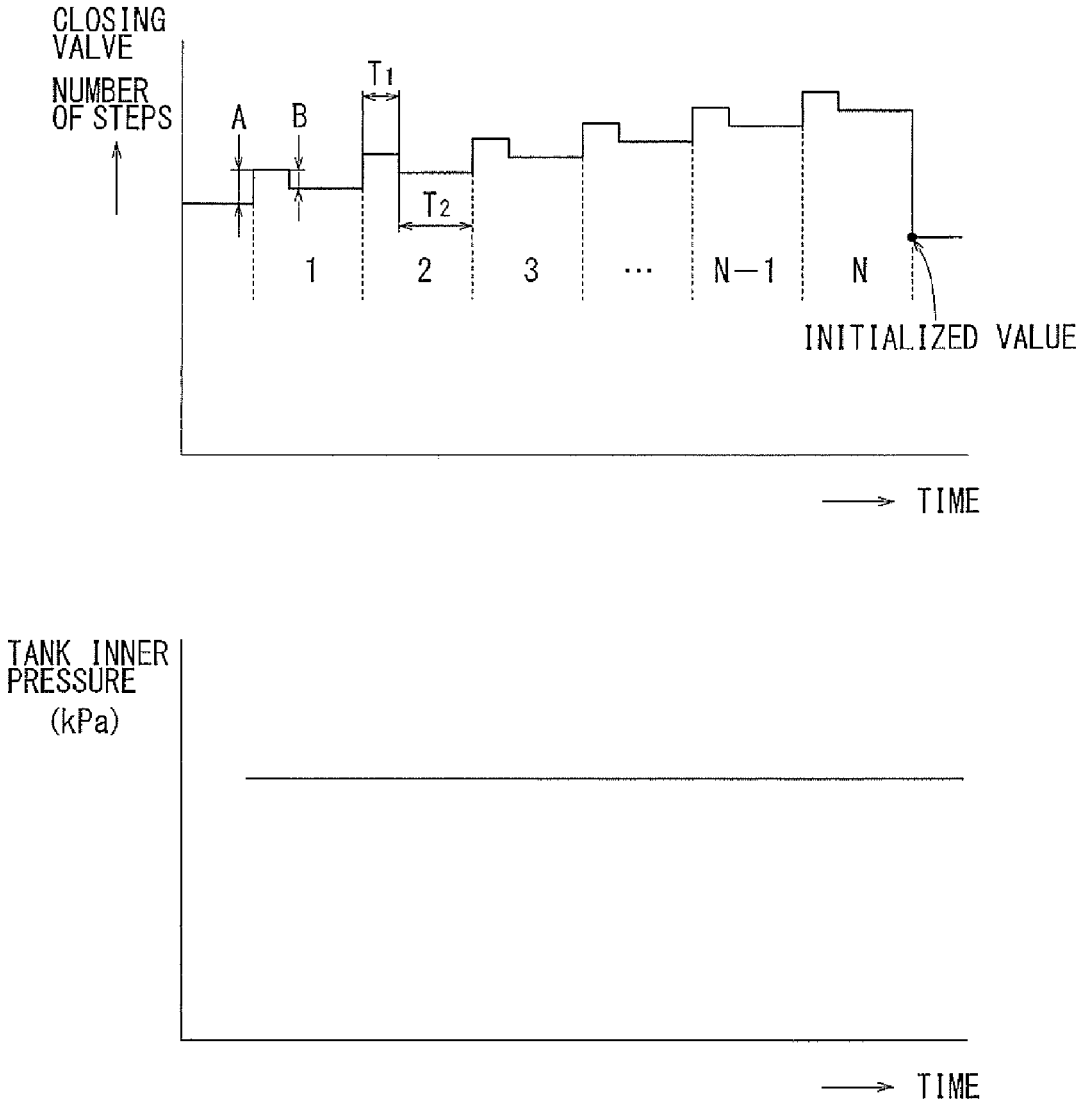
FIG. 7 is a graph illustrating the learning control in a state that the tank inner pressure cannot be detected.

Next, the learning control of the closing valve 40 at the valve opening start position will be described with reference to FIGS. 5-7. Each of upper portions of FIGS. 6 and 7 shows a change in the number of steps of the stepping motor 50 of the closing valve 40, that is, the stroke amount (travel distance in an axial direction) of the valve guide 60 and the valve body 70 based on time (horizontal axis). Further, a lower portion of FIG. 6 shows a change in the tank inner pressure during the learning control in which the tank inner pressure sensor 15*p* is in a "normal condition," wherein the sensor 15*p* is able to detect the tank inner pressure. Whereas, a lower portion of FIG. 7 shows the tank inner pressure in a state that the tank inner pressure sensor 15*p* is in an "abnormal condition," wherein the sensor 15*p* is not able to detect the tank inner pressure due to, for example, some failure (e.g., disconnection or short-circuiting of sensor 15*p*, failure of controller circuit, etc.). When the learning control for the valve opening start position of the closing valve 40 is started, the operation progresses to step S107 from step S101 in FIG. 5 in order to perform the valve opening process. That is, as shown in the upper portion of FIG. 6, the stepping motor 50 of the closing valve 40 is rotated in the valve opening direction by A step (e.g., 4 steps) and is maintained for a predetermined time $T_1$. After maintaining the position of the stepping motor 50 (and thus the position of the valve guide 60) for the predetermined time $T_1$ (step S101 is YES), the operation progresses to step S108 from step S102 in order to perform the valve closing process. That is, the stepping motor 50 of the closing valve 40 is rotated in the valve closing direction by B step (e.g., 2 steps) and is maintained for a predetermined time $T_2$. During maintaining of the position of the stepping motor 50 for the predetermined time $T_2$, the tank inner pressure is detected. Then, when the operation progresses to step S103 from steps S101 and S102, it is determined whether the change ΔP in the tank inner pressure is larger than ΔP1 (0.3 kPa) or not. Because the change ΔP in the tank inner pressure is smaller than ΔP1 (0.3 kPa) at time $T_{X1}$ in FIG. 6 (step S103 in FIG. 5 is NO), it is determined whether the number of rotating processes of the stepping motor 50 in both the valve opening direction (A step) and the valve closing direction (B step) is not less than (i.e., greater than or equal to) N or not. In the first process, the number of rotating processes of the stepping motor 50 in both the valve opening direction (A step) and the valve closing direction (B step) is one (step S105 is NO), so that the operation is returned to step S101.

The operation including following steps is repeatedly performed: as described above, rotating the stepping motor 50 of the closing valve 40 by A step (e.g., 4 steps), maintaining the position of the stepping motor 50 for the predetermined time $T_1$, rotating the stepping motor 50 in the valve closing direction by B step (e.g., 2 steps), maintaining the position of the stepping motor 50 for the predetermined time $T_2$, and detecting the tank inner pressure while maintaining the position of the stepping motor 50 for the predetermined time $T_2$. When the change ΔP in the tank inner pressure is larger than ΔP1 (0.3 kP1) (step S103 in FIG. 5 is YES) as shown at time T×n in FIG. 6, the number of steps of the closing valve 40 at the last process (time T×n−1 in FIG. 6), for example, added with 1 step is stored as the number of steps at the valve opening start position of the closing valve 40, that is, the learning value, and the learning control is finished (step S104 in FIG. 5). When the learning control is completed, the number of steps of the closing valve 40 is returned to the number of steps at a standby position. Here, the standby position is a position where the stepping motor 50 is rotated by 8 steps in the valve closing direction from the learning value (the number of steps) and where the closing valve 40 is closed. Thus, when the closing valve 40 in the standby position receives a signal for operating in the valve opening direction, the closing valve 40 can quickly open.

Figure 8:
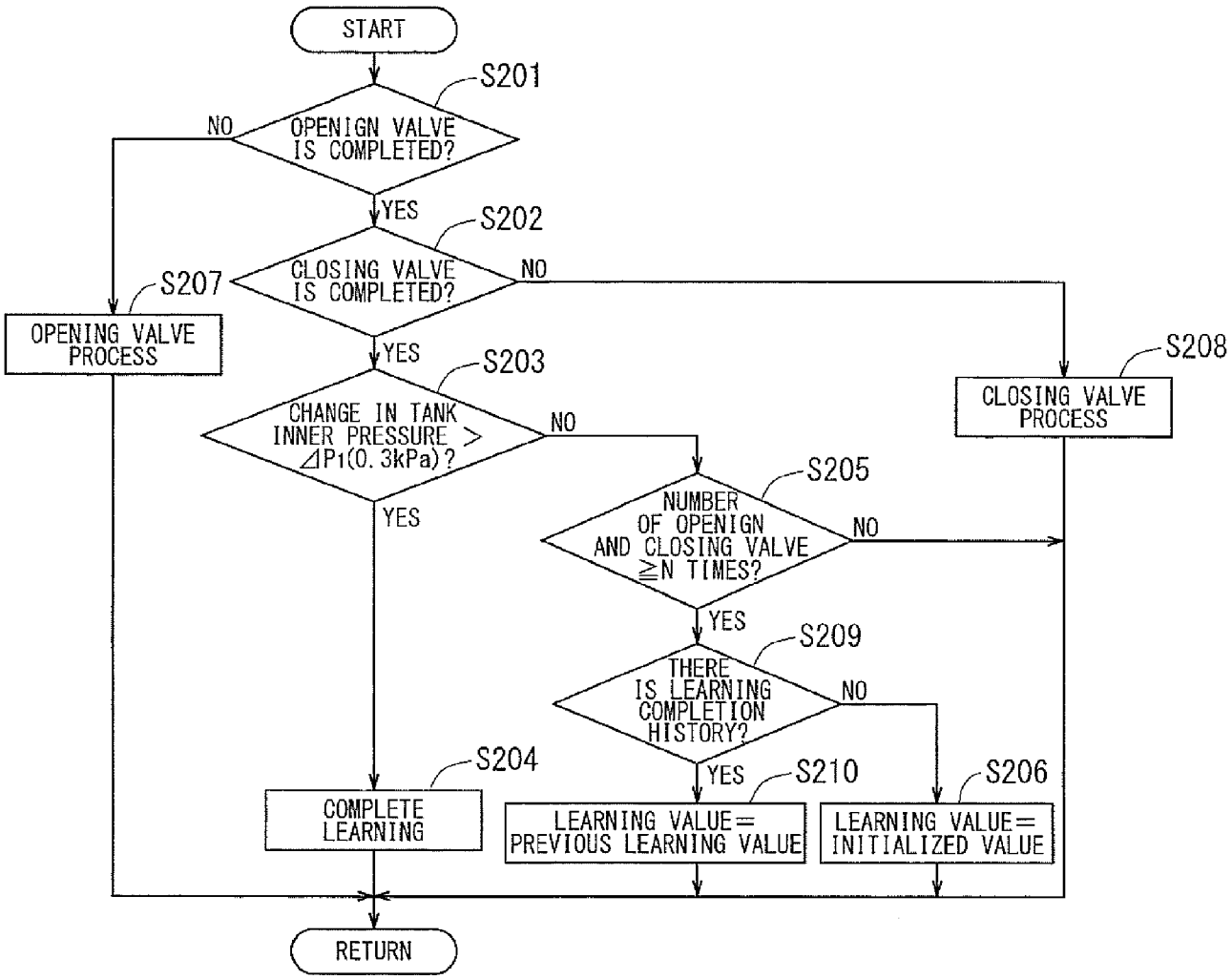
FIG. 8 is a flowchart illustrating the learning control according to a first modification.

In a state that the tank inner pressure sensor 15*p* is in the abnormal condition as shown in the lower portion of FIG. 7, even if the process is repeatedly performed by rotating the stepping motor 50 of the closing valve 40 in the valve opening direction, maintaining the position of the stepping motor 50 for the predetermined time $T_1$, rotating the stepping motor 50 in the valve closing direction, maintaining the position of the stepping motor 50 for the predetermined time $T_2$, and detecting the tank inner pressure while maintaining the position of stepping motor 50 for the predetermined time $T_2$, the change ΔP in the tank inner pressure is not larger than (i.e., less than or equal to) $\Delta P_1$ (0.3 kPa). Thus, when the process is repeatedly performed such that the number of executions of the process is larger than a predetermined number N (step S105 in FIG. 5 is YES), the learning value of the closing valve 40 at the valve opening start position is set at an initial condition. That is, the learning value of the closing valve 40 at the valve opening start position is set at the number of steps at the initialized position (initialized value=0 step) and the learning control is finished (step S106). In this way, the process for rotating the stepping motor 50 by A step (e.g., 4 steps) in the valve opening direction, maintaining the position of the stepping motor 50 (and thus the valve guide 60) for the predetermined time $T_1$, rotating the stepping motor 50 by B step (e.g., 2 steps) in the valve closing direction, and maintaining the position of the stepping motor 50 (and thus the valve guide 60) for the predetermined time $T_2$ in the learning control corresponds to a stroke control process in this disclosure. The flowchart of FIG. 5 shows the operation in which the learning value of the closing valve 40 at the valve opening start position is set at the number of steps at the initialized position (0 step) in the state that the tank inner pressure sensor 15*p* is in the abnormal condition. However, as shown in step S209 in the flowchart of FIG. 8 according to the first modification, when there is a learning history (step S209 is YES), the learning value of the closing valve 40 at the valve opening start position is set at the leaning value learned in the last time (step S210). Thus, the number of steps of the closing valve 40 at the initialized position (0 step) or the learning value in the last time corresponds to a fail-safe value in this disclosure.

In the vaporized fuel processing apparatus 20 according to the present embodiment, when the inner pressure of the fuel tank 15 (the tank inner pressure) does not decrease by higher than the predetermined value ($\Delta P_1$=0.3 kPa) after the process for changing the stroke amount (the number of steps) in both the valve opening direction (A step) and the valve closing direction (B step) is repeated beyond the predetermined number of times during the learning of the valve opening start position of the closing valve 40, the learning value that is the stroke amount of the closing valve 40 at the valve opening start position is set at the fail-safe value (the number of steps at the initialized position (0 step), the learning value in the last time), in which the closing valve 40 is in the closed state. Thus, for example, even if the inner pressure of the fuel tank 15 cannot be detected during the learning control, the learning value is set at the fail-safe value, in which the closing valve 40 is in the closed state. Accordingly, there is no failure where the stroke amount in a state that the closing valve 40 is open is erroneously stored as the learning value.

Figure 9:
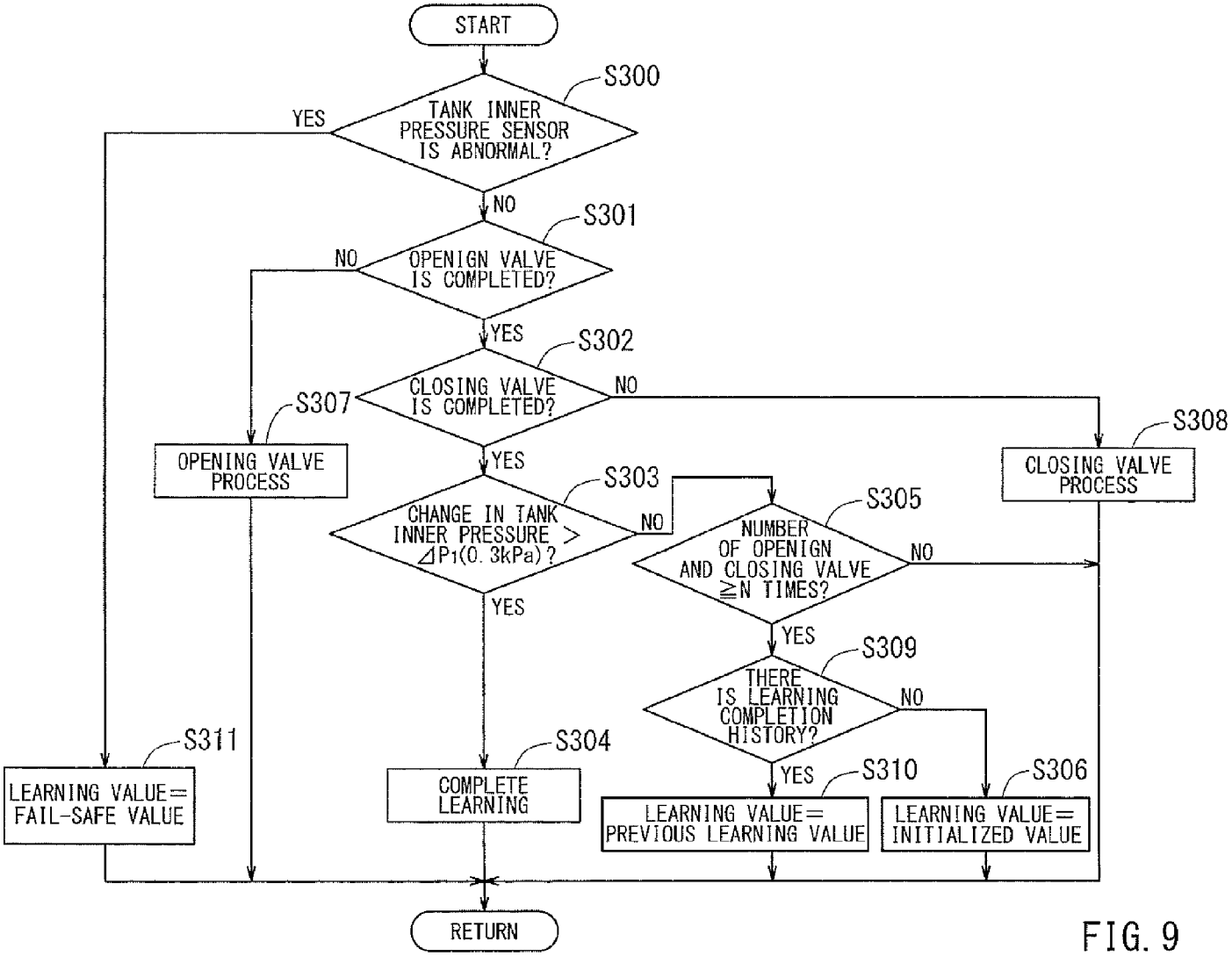
FIG. 9 is a flowchart illustrating the learning control according to a second modification.
Figure 10:
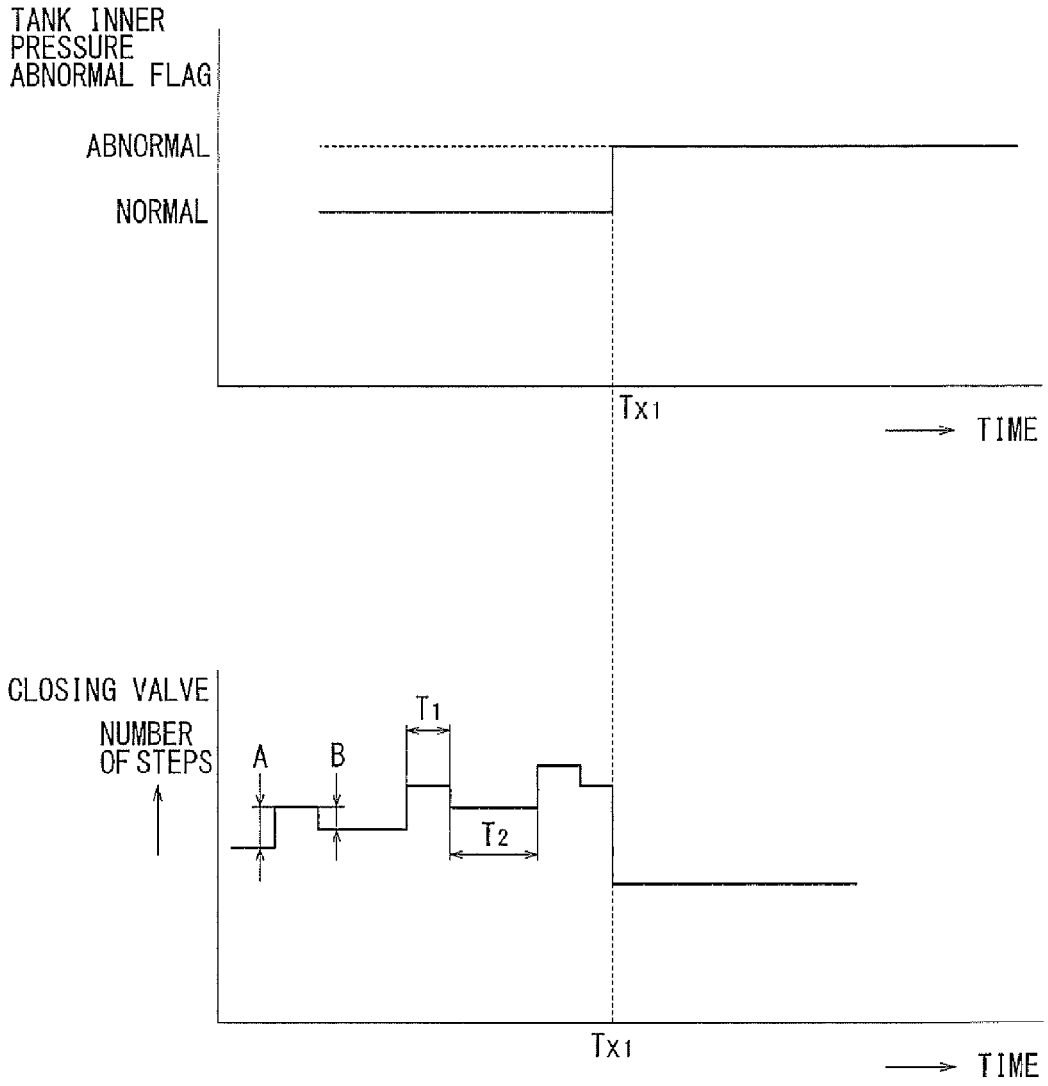

Next, the learning control of the closing valve 40 at the valve opening start position according to a second modification will be described with reference to FIGS. 9 and 10. In the learning control of the valve opening start position of the closing valve 40, in a state that the abnormality of the tank inner pressure sensor 15*p* is detected (the tank inner pressure abnormal flag is on), even if the process for rotating the stepping motor 50 in both the valve opening direction and the valve closing direction and detecting the tank inner pressure has not been repeated at N times, the learning control can be finished. That is, as shown in FIG. 10, while the process for rotating the stepping motor 50 of the closing valve 40 by A step in the valve opening direction, maintaining the position of the stepping motor 50 for the predetermined time $T_1$, rotating the stepping motor by B step in the valve closing direction, and maintaining the position of the stepping motor 50 for the predetermined time $T_2$ is repeated, when the tank inner pressure abnormal flag is on (step S300 in FIG. 9 is YES), the learning value is set at the fail-safe value (step S311). Here, the fail-safe value is the learning value in the last time in a case that the there is the learning history (step S309 is YES), and the fail-safe value is the number of steps at the initialized position (the initialized value=0 step) in a case that there is no learning history (step S309 is NO).

Figure 11:
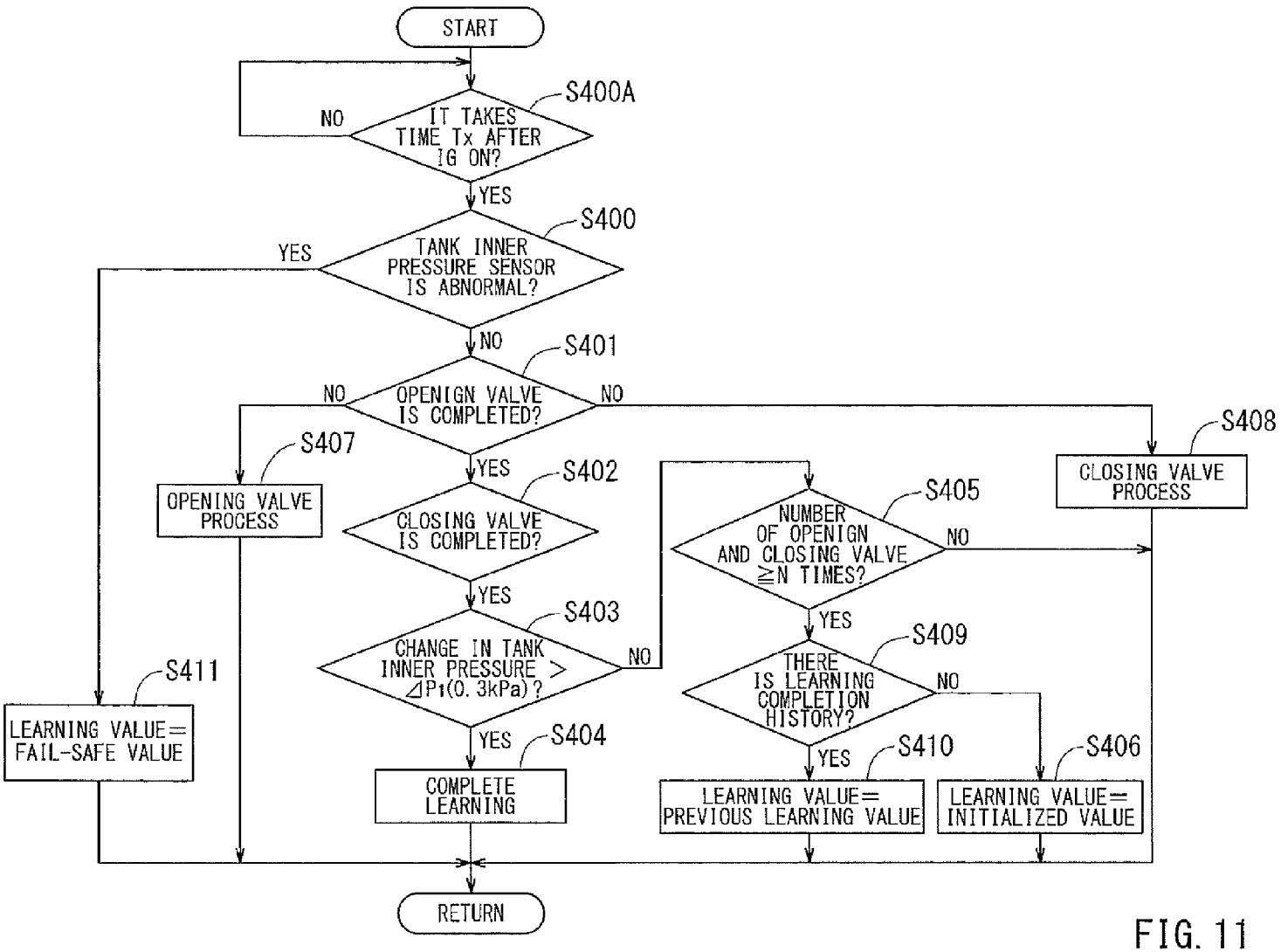
FIG. 11 is a flowchart illustrating the learning control according to a third modification.
Figure 12:
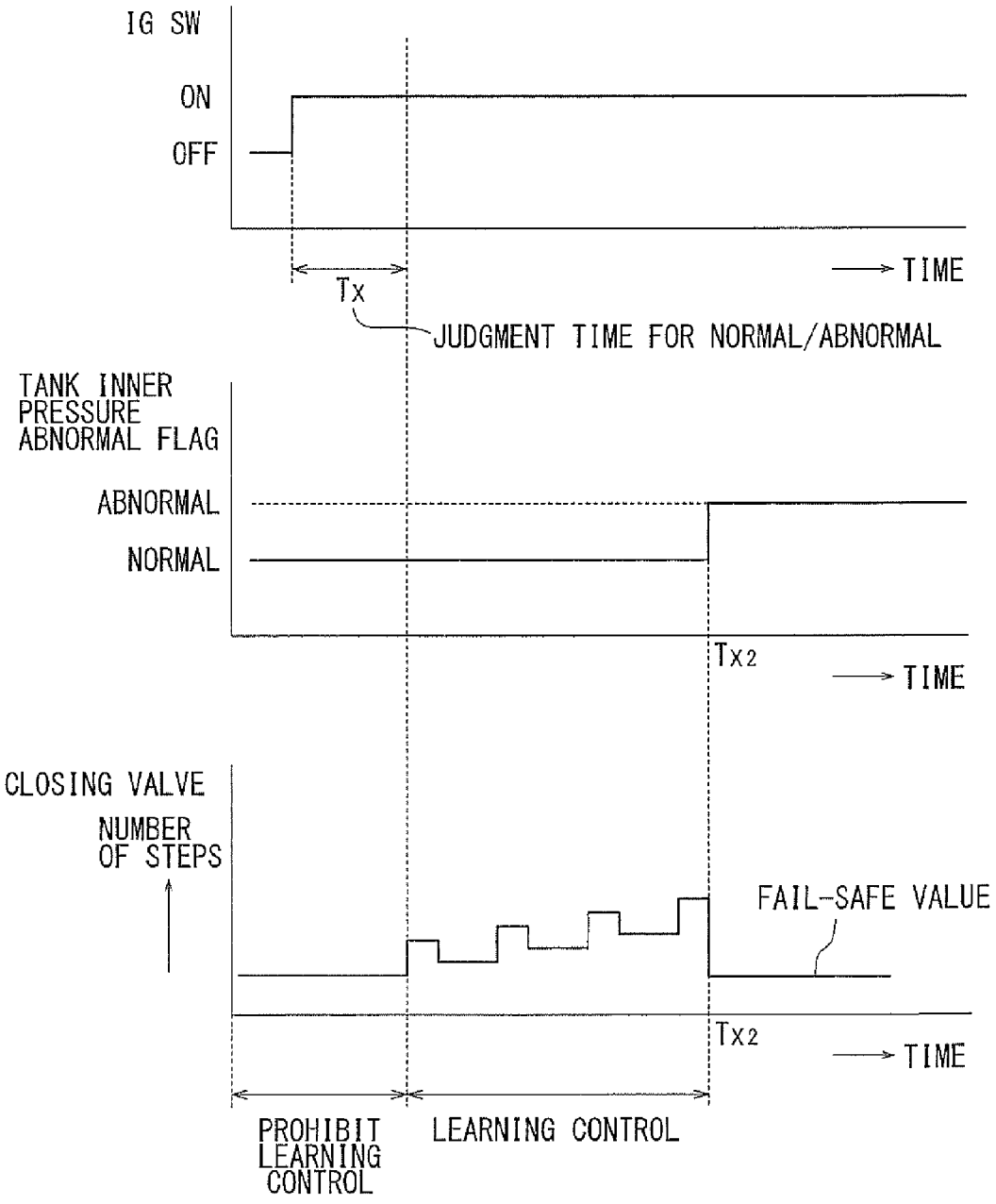

Next, the learning control of the valve opening start position of the closing valve 40 according to a third modification will be described with reference to FIGS. 11 and 12. In the learning control of the valve opening start position of the closing valve 40 according to the third modification, the learning control is not started for a predetermined time $T_X$ from when the ignition switch 18 for the engine 14 is turned on. Here, the predetermined time $T_X$ is a period of time required for the ECU 19 to determine whether the tank inner pressure sensor 15*p* is in the normal condition or in the abnormal condition. Thus, when it takes the predetermined time $T_X$ after the ignition switch 18 is turned on (step S400A in FIG. 11 is YES), it is checked whether the tank inner pressure abnormal flag is on or off (step S400). When the tank inner pressure abnormal flag is on (step S400 is YES), the learning value of the valve opening start position of the closing valve 40 is set at the fail-safe value, and the learning control is prohibited. When the tank inner pressure abnormal flag is off (step S400 is NO), the learning control is started as shown in FIG. 12. That is, the process for rotating the stepping motor 50 of the closing valve 40 by A step in the valve opening direction, maintaining the position of the stepping motor 50 for the predetermined time $T_1$, rotating the stepping motor 50 by B step in the valve closing direction, and maintaining the position of the stepping motor 50 for the predetermined time $T_2$ is repeated. However, when the tank inner pressure abnormal flag is on during the learning control (step S400 in FIG. 11 is YES) as shown at time $T_{X2}$ in FIG. 12, the learning value is set at the fail-safe value, and the learning control is finished (step S411).

Figure 14:
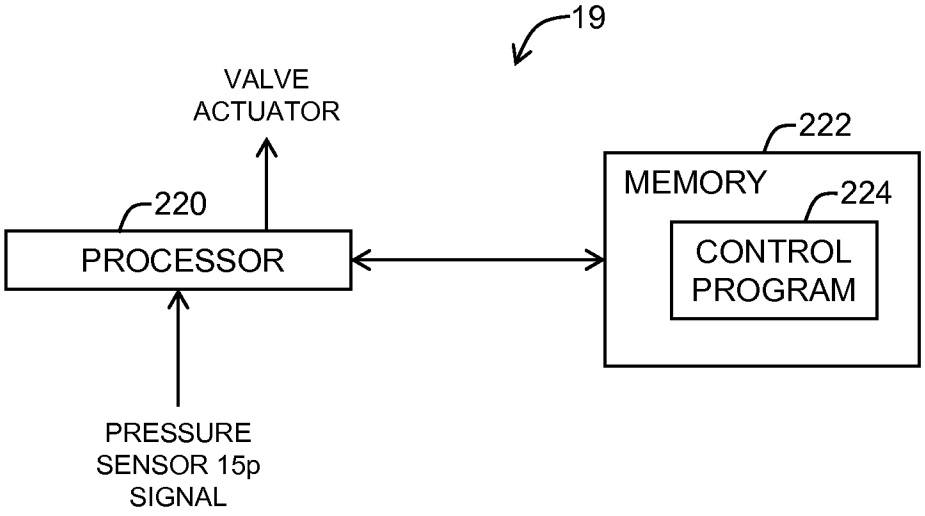
FIG. 14 is a block diagram of an example of a controller to learn a valve opening start position as disclosed herein.

FIG. 14 shows an example of the ECU 19. In this example, the ECU 19 includes a processor 220 coupled to memory 222. Memory 222 includes a control program 224 which is executable by the processor 220. When the control program 224 is executed, the processor 220 performs any or all of the various functions described herein as attributed to the ECU 19.

For example, the control program 224 may cause the processor 220 to learn the valve opening start position for the valve movable portion (e.g., valve guide 60) when the pressure within the fuel tank 15 (e.g., as measured by sensor 15*p*) decreases by greater than or equal to a predetermined value by increasing the stroke amount or distance of the valve movable portion (e.g., FIGS. 6 and 7). In addition, the control program 224 may cause the processor 220 to set a learning value that is the stroke amount at the valve opening start position at a fail-safe value such that the closing valve is in a closed state when the inner pressure of the fuel tank decreases by less than the predetermined value after repeatedly changing the stroke amount a predetermined number of times.

Figure 13:
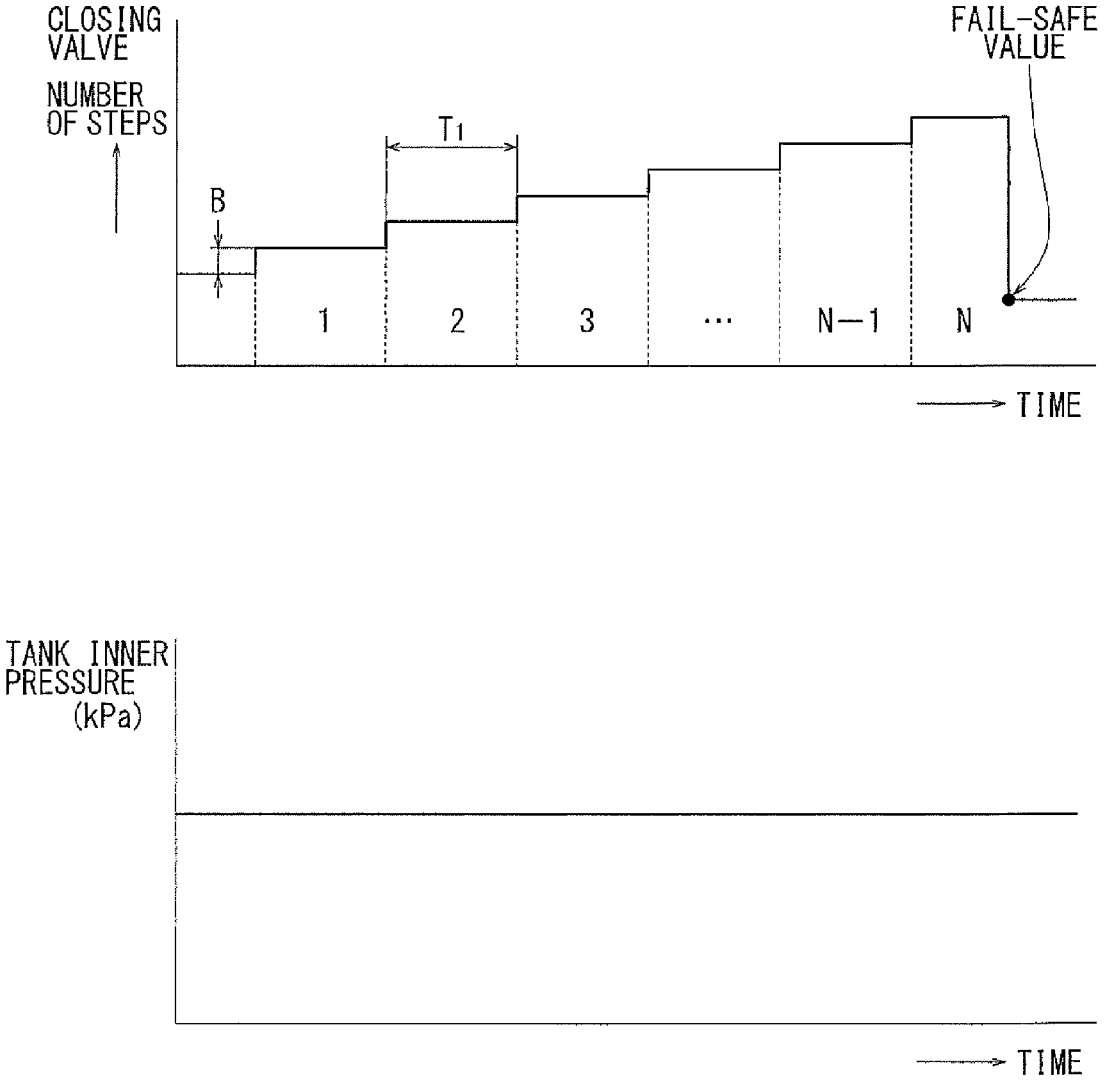
FIG. 13 is graph illustrating the learning control in the state that the tank inner pressure can be detected.

The present disclosure can be further modified without departing from the scope of the invention. For example, in the learning controls according to these embodiments, as shown in FIG. 7, etc., the closing valve 40 is opened in stages by repeating the process for rotating the stepping motor 50 by A step (e.g., 4 steps) in the valve opening direction, maintaining the position of the stepping motor 50 for the predetermined time $T_1$, rotating the stepping motor 50 by B step (e.g., 2 steps) in the valve closing direction, and maintaining the position of the stepping motor 50 for the predetermined time $T_2$. However, as shown in FIG. 13, the closing valve 40 can be opened in stages in the learning control by repeating a process for rotating the stepping motor by B step (e.g., 2 steps) in the valve opening direction, and maintaining the position of the stepping motor 50 for the predetermined time $T_1$. In these embodiments, in the state that the change in the tank inner pressure cannot be detected due to the abnormality of the tank inner pressure sensor 15*p*, when the number of executions of the process for operating the closing valve 40 in both the valve opening direction and the valve closing direction is beyond the predetermined number of times N, the learning value of the valve opening start position of the closing valve 40 is set at the fail-safe value. However, although the tank inner pressure sensor 15*p* is in the normal condition, there is a case that the tank inner pressure does not decrease by higher than the predetermined value $\Delta P_1$ after start of opening of the closing valve 40, for example, in a condition that the tank inner pressure is low. Even if in such condition, it is preferred to set the learning value of the valve opening start position of the closing valve 40 at the fail-safe value when the number of executions of the process for operating the closing valve 40 in both the valve opening direction and the valve closing direction is beyond the predetermined number of times N. Further, the stepping motor 50 is used as a motor of the closing valve 40 in these embodiments, a DC motor or the like can be used instead of the stepping motor 50. It should be appreciated that the stroke amount described herein can be decided and/or detected based on, for example, a value detected by a stroke sensor, or, in embodiments which utilize a stepping motor (e.g., motor 50) the number of steps of the stepping motor.

The invention claimed is:

1. A vaporized fuel processing apparatus comprising:

a canister capable of adsorbing vaporized fuel generated in a fuel tank;

a vapor path connecting the canister and the fuel tank to each other;

a closing valve provided in the vapor path and having a valve seat and a valve movable portion, the valve movable portion having an axis and being capable of moving in an axial direction of the valve movable portion respect to the valve seat, the closing valve being in a valve closing state capable of maintaining the fuel tank in a hermetic state when a stroke amount, that is an axial distance between the valve seat and the valve movable portion, is within a predetermined range from zero;

a pressure sensor configured to detect an inner pressure of the fuel tank; and an electric control unit configured to:

learn a valve opening start position of the closing valve as the stroke amount when the inner pressure of the fuel tank decreases by greater than or equal to a predetermined value by increasing the stroke amount by a stroke control process; and set a learning value that is the stroke amount at the valve opening start position at a fail-safe value such that the closing valve is in the valve closing state when the inner pressure of the fuel tank decreases by less than the predetermined value after repeating the stroke control process more than a predetermined number of times.

2. The vaporized fuel processing apparatus according to claim 1, wherein the electronic control unit is configured to change the stroke amount in the valve opening direction by a first predetermined stroke amount and then change the stroke amount in the valve closing direction by a second predetermined stroke amount smaller than the first predetermined stroke amount.

3. The vaporized fuel processing apparatus according to claim 1, wherein the electric control unit is configured to prohibit the learning of the valve opening start position of the closing valve and set the learning value at the fail-safe value when the pressure sensor cannot detect the inner pressure of the fuel tank.

4. The vaporized fuel processing apparatus according to claim 1, wherein the electric control unit is configured to determine whether the pressure sensor is able to detect the inner pressure of the fuel tank or not, and wherein the electric control unit is configured to prohibit the learning of the valve opening start position of the closing valve after an ignition switch for an engine is turned on and before the electric control unit determines whether the pressure sensor is able to detect the inner pressure of the fuel tank or not.

5. The vaporized fuel processing apparatus according to claim 4, wherein the electric control unit is configured to set the learning value at the fail-safe value when the electric control unit determines that the pressure sensor cannot detect the inner pressure of the fuel tank.

6. The vaporized fuel processing apparatus according to claim 1, wherein the fail-safe value corresponds to a position where the closing valve is mechanically completely closed.

7. The vaporized fuel processing apparatus according to claim 1, wherein the electric control unit is configured to store the learning value of the valve opening start position of the closing valve during the learning of the valve opening start position, and wherein when the electric control unit stores at least one learning value, the fail-safe value is the learning value learned in the last learning of the valve opening start position.

8. A fuel vapor control device, comprising:

memory containing a control program; and a processor coupled to the memory and configured to execute the control program;

wherein, upon executing the control program, the processor is to:

learn a valve opening start position for a valve movable portion of a closing valve disposed along a vapor path extending between a canister and a fuel tank as the stroke amount of the valve movable portion from a valve seat when the pressure within the fuel tank decreases by greater than or equal to a predetermined value by increasing the stroke amount; and set a learning value that is the stroke amount at the valve opening start position at a fail-safe value such that the closing valve is in a closed state when the inner pressure of the fuel tank decreases by less than the predetermined value after repeatedly changing the stroke amount a predetermined number of times.

* * * * *